United States Patent [19]

Matz, Jr.

[11] Patent Number: 4,801,946

[45] Date of Patent: Jan. 31, 1989

[54] GRID ANTENNA

[75] Inventor: Donald W. Matz, Jr., Lockport, Ill.

[73] Assignee: Mark Antenna Products, Inc., Des Plaines, Ill.

[21] Appl. No.: 461,143

[22] Filed: Jan. 26, 1983

[51] Int. Cl.[4] ..... H01Q 15/14

[52] U.S. Cl. ..... 343/840; 343/912

[58] Field of Search ..... 343/840, 912

[56] References Cited

U.S. PATENT DOCUMENTS

| | | | |
|---|---|---|---|
| 2,423,648 | 7/1947 | Hansell | 343/840 |
| 2,530,098 | 11/1950 | Van Atta | 343/840 |
| 2,703,842 | 3/1955 | Lewis | 343/840 |
| 2,850,735 | 9/1958 | Harris | 343/840 |
| 3,178,713 | 4/1965 | Yang | 343/840 |
| 3,274,603 | 9/1966 | Kay | 343/786 |
| 3,553,707 | 1/1971 | Yang et al. | 343/781 R |
| 4,168,504 | 9/1979 | Davis | 343/786 |
| 4,405,928 | 9/1983 | Elsbernd | 343/912 |
| 4,414,516 | 11/1983 | Howard | 343/786 |
| 4,477,816 | 10/1984 | Cho | 343/786 |

FOREIGN PATENT DOCUMENTS

| | | |
|---|---|---|
| 595062 | 11/1947 | United Kingdom . |
| 795428 | 5/1958 | United Kingdom . |
| 817170 | 7/1959 | United Kingdom . |
| 1457907 | 12/1976 | United Kingdom . |

*Primary Examiner*—William L. Sikes
*Assistant Examiner*—Michael C. Wimer
*Attorney, Agent, or Firm*—Charles F. Pigott, Jr.; Garrettson Ellis

[57] ABSTRACT

A grid parabolic antenna formed of a peripheral hoop and a plurality of metallic reflector ribs arranged in planes substantially parallel to each other and connected to the hoop. The reflector ribs each have an elongated cross-sectional configuration, with the elongation being in a direction that is generally parallel to the axis of the antenna feed which is at the focus of the parabola.

7 Claims, 2 Drawing Sheets

FIG. 1
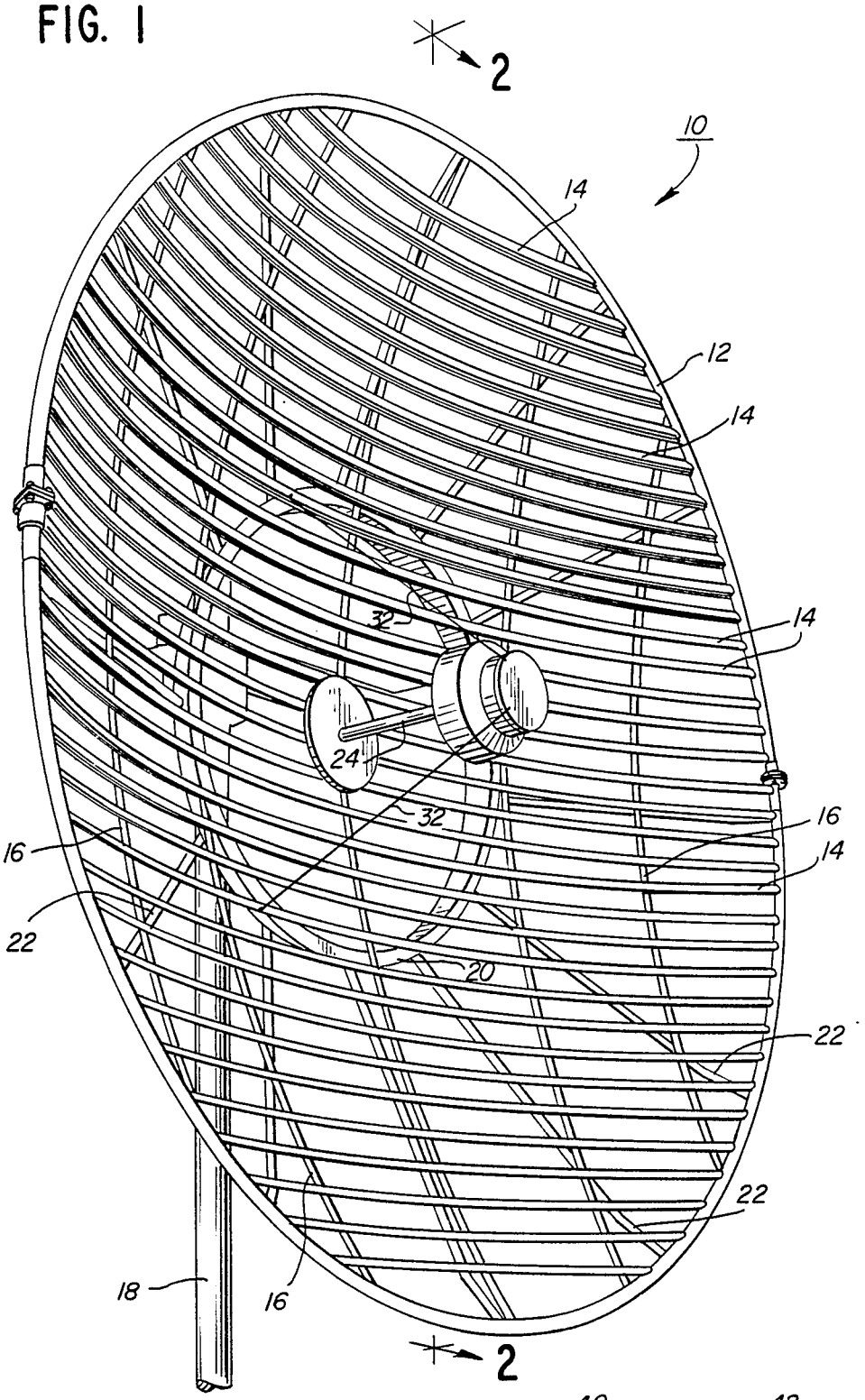
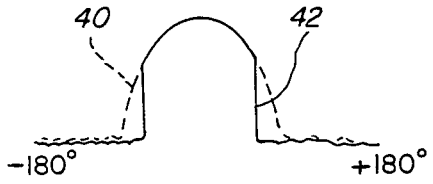
FIG. 7

FIG. 2
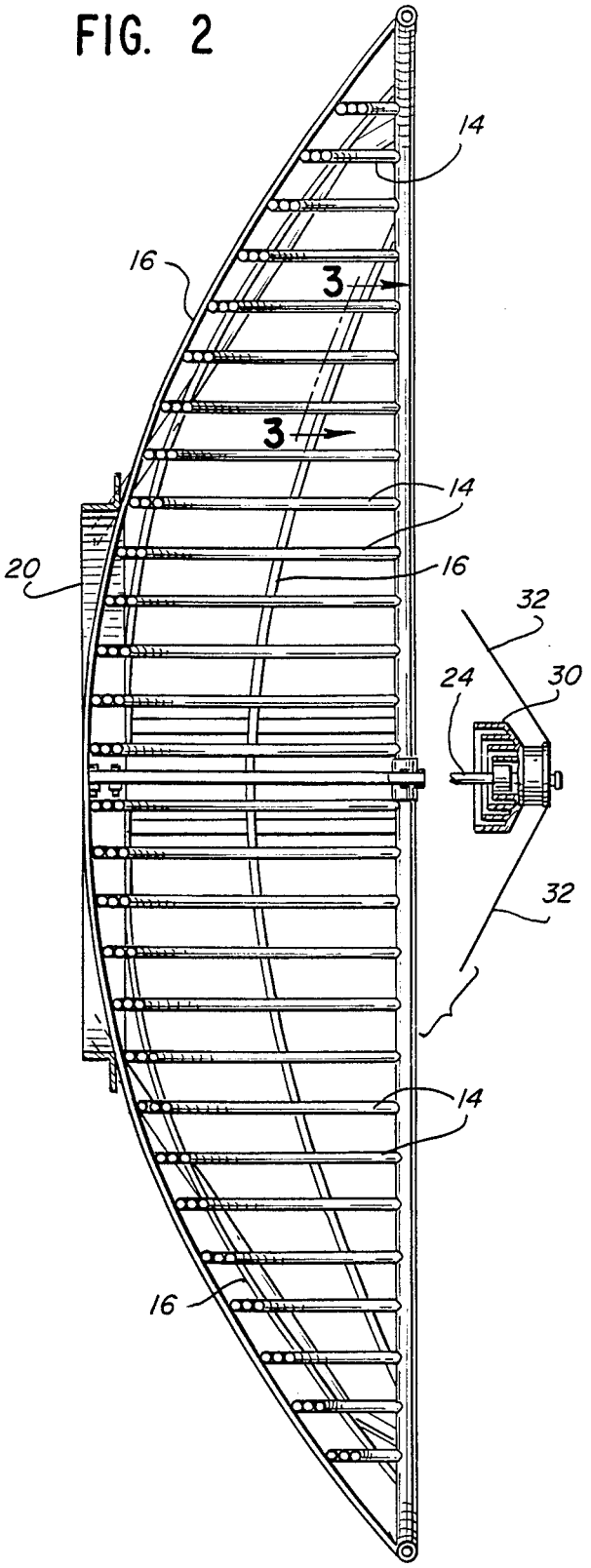
FIG. 3
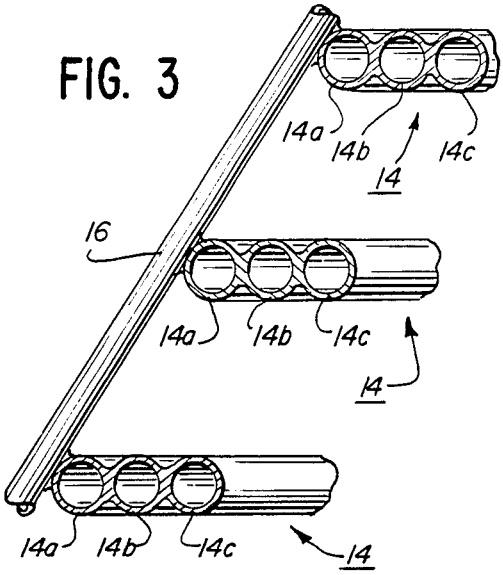
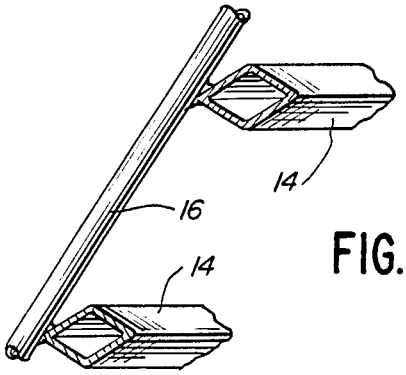
FIG. 4
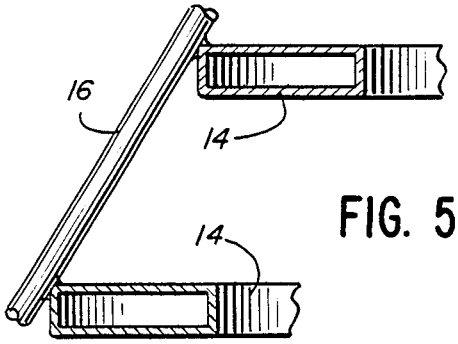
FIG. 5
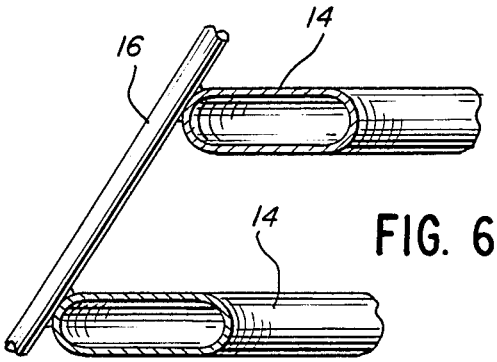
FIG. 6

GRID ANTENNA

BACKGROUND OF THE INVENTION

The present invention concerns a novel grid parabolic antenna which is constructed in a manner for reducing the amount of back radiation.

In U.S. Pat. No. 2,850,735, a grid parabolic antenna is disclosed in which a number of spaced parallel aluminum tubular reflector ribs are contoured and their ends are connected to a peripheral hoop to form a parabolic antenna structure. A primary advantage of the grid type parabolic antenna over a solid parabolic antenna is that the grid antenna has wind loading characteristics of only 20 percent to 40 percent of comparable size solid parabolas.

Both grid type parabolic antennas and solid parabolic antennas have leakage around the antenna thereby resulting in a certain amount of side and back radiation. During transmission, the side and back radiation may cause interference with other signals which are being fed in the same direction from other antennas. It has been found that prior art grid antennas, such as illustrated in U.S. Pat. No. 2,850,735, have substantially more back radiation than solid antennas. However, the low wind loading characteristics of the grid antennas makes the use of the grid antennas necessary under many conditions.

FCC Part 94 includes a category A requirement which specifies a maximum amount of side and back radiation that is permitted with respect to parabolic antennas. In the 2100–2300 megahertz band, a conventional six-foot solid parabolic antenna complies with the category A requirement, but the conventional six-foot grid type parabolic antenna does not comply with the category A requirement. Therefore, it has been believed that a six-foot grid type parabolic antenna could not be used in the 2100–2300 megahertz band where FCC Part 94 category A is applicable. However, I have discovered a novel construction for reducing significantly the back radiation of a grid antenna.

Therefore, it is an object of the present invention to provide a grid antenna having less wind resistance than a solid antenna but also having less back radiation than the back radiation provided by prior art grid antennas.

A further object of the present invention is to provide a grid antenna which has substantially no more back radiation than the back radiation of a solid antenna of the same size.

Another object of the present invention is to provide a grid antenna that has reduced back radiation and that is relatively simple in construction and relatively easy to manufacture.

Other objects and advantages of the present invention will become apparent as the description proceeds.

SUMMARY OF THE INVENTION

In accordance with the present invention, a grid parabolic antenna is provided of the type formed of a peripheral hoop and a plurality of spaced metallic reflector ribs having a parabolic contour, with the reflector ribs being arranged in planes substantially parallel to each other and connected to the hoop, and with an antenna feed at the focus of the parabola. The improvement comprises the reflector ribs each having an elongated cross-sectional configuration, with the elongation being in a direction generally parallel to the axis of the feed.

In one embodiment of the invention, the reflector ribs each comprise a plurality of connected circular tubes. In another embodiment of the invention, the reflector ribs each comprise a tubular conductive member with the cross-sectional configuration of the tube having a major axis in a direction generally parallel to the axis of the feed and having a minor axis generally perpendicular to the major axis. In one form of this embodiment, the reflector ribs each comprise a tubular conductive member having a generally rectangular cross-sectional configuration.

In the illustrative embodiment, the feed includes passive means for providing a relatively rectangular primary beam. The passive means comprise a secondary member carried by the feed for providing a phase shift to shape the primary beam so that it is relatively rectangular.

A more detailed explanation of the invention is provided in the following description and claims, and is illustrated in the accompanying drawings.

BRIEF DESCRIPTION OF THE DRAWINGS

FIG. 1 is a perspective view of a grid parabolic antenna constructed in accordance with the principles of the present invention;

FIG. 2 is a cross-sectional view thereof, taken along the plane of the line 2—2 of FIG. 1;

FIG. 3 is an enlarged, broken cross-sectional view, taken along the plane of the line 3—3 of FIG. 2;

FIG. 4 is a cross-sectional view similar to FIG. 3, but showing another form of reflector ribs;

FIG. 5 is a cross-sectional view similar to FIG. 3, but showing a further form of reflector ribs;

FIG. 6 is a cross-sectional view similar to FIG. 3, but showing an additional form of reflector ribs; and FIG. 7 is a diagram of a beam pattern of a grid parabolic antenna, showing the beam pattern of a conventional grid parabolic antenna in phantom lines and showing, in full lines, the beam pattern of a grid parabolic antenna constructed in accordance with the principles of the present invention.

DETAILED DESCRIPTION OF THE ILLUSTRATIVE EMBODIMENT

Referring to the drawings, a grid parabolic antenna 10 is shown therein comprising a circumferential hoop 12 preferably formed of aluminum tubing and a number of spaced reflector ribs 14 preferably formed of aluminum. Each of the reflector ribs has a parabolic contour as illustrated in FIG. 1 and has its ends connected to hoop 12. As is conventional in grid parabolic antenna designs, the reflector ribs are supportedly connected to a number of metallic straps 16 which are contoured as illustrated in FIG. 1 and have their ends connected to hoop 12. The assembly is connected to and supported by a mast 18 through a back ring 20 and a ring back mount as is well-known in the art. A number of back braces 22 have their ends connected to back rings 20 and hoop 12.

Spaced reflector ribs 14 each lie in planes that are parallel to each other. Spaced straps 16 each lie in planes that are parallel to each other and are perpendicular to the planes in which reflector ribs 14 lie. An antenna feed 24 extends from the focus of the parabola formed by the reflector ribs 14 in the manner illustrated in FIGS. 1 and 2.

Each of the reflector ribs 14 has an elongated cross-sectional configuration, with the elongation being in a direction that is parallel to the axis of the feed 24. Referring to FIGS. 2 and 3, for example, it is seen that each reflector rib 14 comprises three aluminum tubes 14*a*, 14*b* and 14*c* connected to each other by solder or other suitable means. Each tube 14*a*, 14*b* and 14*c* is identical to the others and it can be seen that the tubes are connected so that they lie in a single plane that is parallel to the plane in which the axis of antenna feed 24 lies. In a specific example, although no limitations are intended, in a six-foot diameter parabolic antenna constructed in accordance with the principles of the present invention, each tube 14*a* has a circular cross-sectional configuration with a ¾ inch diameter, and the reflector ribs 14 are spaced two inches apart from each other.

By utilizing reflector ribs which each have an elongated cross-sectional configuration, with the elongation being in a direction generally parallel to the axis of the feed, the amount of back radiation is reduced substantially. The amount of back radiation using the elongated reflector ribs is further reduced by attaching passive means to the feed comprising a secondary member carried by the feed for providing a phase shift, to shape the primary beam so it is relatively rectangular. To this end, a wave shaping element 30 is attached to feed 24. Feed 24 and its wave shaping element 30 are supported through a number of cables 32, which extend from the wave shaping element 30 to back ring 20. As is conventional, the back end (not shown) of antenna feed 24 has a coaxial coupler for receiving a coaxial cable.

As illustrated in FIG. 2 in cross-section, wave shaping element 30 essentially comprises a number of concentric rings, as is well-known in the art, to shape the primary beam so that it is relatively rectangular. Referring to FIG. 7, which diagrammatically shows the beam over a 360° scale, primary beam 40 is the typical beam from the front of the parabolic antenna without using wave shaping element 30. Using wave shaping element 30, the beam is shaped in a relatively rectangular configuration 42 thus reducing reflector spillover. It has been found that by shaping the beam so that it is relatively rectangular, and also using reflector ribs which have an elongated cross-sectional configuration as illustrated in FIGS. 1–3, the amount of back radiation may be reduced by a factor of 10. This provides a grid antenna which has substantially no greater back radiation than a solid antenna of the same diameter. In this manner, where a solid antenna may be undesirable a grid antenna may be utilized in compliance with the FCC standard described above.

Reflector ribs 14 may have other cross-sectional configurations, so long as the cross-sectional configuration is elongated in a direction generally parallel to the axis of the feed. For example, in FIG. 4 each reflector rib 14 comprises a tubular conductive member with the cross-sectional configuration being generally diamond-shape. The major axis of the diamond is parallel to the axis of feed 24 and the minor axis of the diamond is perpendicular thereto.

Likewise, in FIG. 5 each reflector rib 14 has a generally rectangular cross-sectional configuration, with the major axis of the rectangle being parallel to the axis of feed 24 while the minor axis of the rectangle is perpendicular thereto.

In FIG. 6, reflector ribs 14 are tubular with a generally elliptical cross-sectional configuration. As illustrated in FIG. 6, the major axis of the ellipse is parallel to the axis of feed 24 while the minor axis of the ellipse is perpendicular thereto.

Although antenna 10 has been primarily described as a transmitting antenna, it may also be used as a receiving antenna utilizing the principles of the present invention.

It is seen that a novel grid parabolic antenna has been shown and described which is relatively simple in construction and easy to manufacture, and minimizes the back radiation by utilizing the novel construction. Although illustrative embodiments of the invention have been shown and described, it is understood that various modifications and substitutions may be made by those skilled in the art without departing from the novel spirit and scope of the present invention.

What is claimed is:

1. In a grid parabolic antenna formed of a peripheral hoop and a plurality of spaced metallic reflector ribs having a parabolic contour, the reflector ribs being arranged in planes substantially parallel to each other and being connected to the hoop, an antenna feed at the focus of the parabola, the improvement comprising:

said reflector ribs each comprising a plurality of connected circular tubes and having an elongated cross-sectional configuration, the elongation being in a direction generally parallel to the axis of the feed.

2. In a grid parabolic antenna as described in claim 1, said feed including passive means for providing a relatively rectangular primary beam.

3. In a grid parabolic antenna as described in claim 2, said passive means comprising a wave shaping element which provides a phase shift.

4. In a grid parabolic antenna as described in claim 2, said passive means comprising a secondary member carried by the feed for providing a phase shift to shape the primary beam so that it is relatively rectangular.

5. In a grid parabolic antenna formed of a peripheral hoop and a plurality of spaced metallic reflector ribs having a parabolic contour, the reflector ribs being arranged in planes substantially parallel to each other and being connected to the hoop, an antenna feed at the focus of the parabola, the improvement comprising:

said reflector ribs each having an elongated cross-sectional configuration, the elongation being in a direction generally parallel to the axis of the feed;

said feed including passive means for providing a relatively rectangular primary beam.

6. In a grid parabolic antenna as described in claim 5, said reflector ribs each comprising a tubular conductive member with the cross-sectional configuration of the tube having a major axis in a direction generally parallel to the axis of the feed and having a minor axis generally perpendicular to the major axis.

7. In a grid parabolic antenna as described in claim 5, said passive means comprising a secondary member carried by the feed for providing a phase shift to shape the primary beam so that it is relatively rectangular.

* * * * *